United States Patent [19]

Buonomo et al.

[11] Patent Number: 4,578,161

[45] Date of Patent: Mar. 25, 1986

[54] PROCESS FOR PREPARING QUATERNARY AMMONIUM HYDROXIDES BY ELECTROLYSIS

[75] Inventors: Franco Buonomo, Milan; Giuseppe Bellussi, Piacenza; Bruno Notari, Milan, all of Italy

[73] Assignee: Enichimica S.p.A., Milan, Italy

[21] Appl. No.: 589,531

[22] Filed: Mar. 14, 1984

[30] Foreign Application Priority Data

Mar. 17, 1983 [IT] Italy ..... 20115 A/83

[51] Int. Cl.[4] ..... C25B 1/00

[52] U.S. Cl. ..... 204/102; 204/128; 204/129

[58] Field of Search ..... 204/72, 102, 128, 98, 204/129

[56] References Cited

U.S. PATENT DOCUMENTS

| | | | |
|---|---|---|---|
| 3,402,115 | 9/1968 | Campbell et al. | 204/180 P |
| 3,523,068 | 8/1970 | Eisenhauer et al. | 204/72 |
| 4,394,226 | 7/1983 | Wade et al. | 204/72 |

*Primary Examiner*—John F. Niebling
*Assistant Examiner*—Terryence Chapman
*Attorney, Agent, or Firm*—Hedman, Gibson, Costigan & Hoare

[57] ABSTRACT

A process for preparing quaternary ammonium hydroxides by electrolysis in an electrolytic cell comprising two compartments, namely an anode and a cathode compartment, separated by an anion exchange permselective membrane, starting from quaternary ammonium halides.

10 Claims, 4 Drawing Figures

PROCESS FOR PREPARING QUATERNARY AMMONIUM HYDROXIDES BY ELECTROLYSIS

BACKGROUND OF THE INVENTION

1. Field of the Invention

This invention relates to a process for the synthesis of quaternary ammonium hydroxides by an electrolytic process.

2. Description of the Related Art

Quaternary ammonium hydroxides are currently used industrially as support electrolytes, as stabilisers or solubilisers for organic compounds in aqueous solutions in electrochemical processes, as microbicides, as template agents in the synthesis of numerous zeolites, etc.

The direct synthesis of quaternary ammonium salts is normally effected by a reaction of addition starting from the corresponding trialkylamine and the alkyl sulphate, carbonate or halide. The alkyl sulphates and carbonates, and in particular methyl and ethyl sulphates, are compounds of high teratogenic activity.

In contrast the halogenated compounds are relatively harmless. In addition, the alkyl chlorides, bromides and iodides add extremely easily to trialkylamines, to form the corresponding quaternary ammonium salts.

The methods mostly used for converting the salt to the hydroxide are: reaction between the halide and the hydrated oxide of a metal of which the halide is insoluble in water ($Ag_2O$, HgO) as described for example in S.U. Pat. No. 662,547; exchange over cation resin as described in U.S. Pat. No. 3,579,581; or exchange against KOH in alcoholic solutions of tetraalkylammonium chlorides or bromides (ANAL. CHEM. vol. 34, 1962 page 172).

In preparing $Ag_2O(H_2O)$ and $HgO(H_2O)$, alkalis (NaOH, KOH) are used and these become strongly absorbed by the hydrated oxide. Elimination of the alkaline residues requires considerable time and wash water, otherwise an ammonium base is obtained containing high concentrations of undesirable alkaline metals. The overall process, considering the high cost of the metals used, is not economical for the industrial production of quaternary ammonium bases. In the other process, using anion exchange resins, the low exchange capacity of the resins leads to low ammonium base productivity per passage and per unit of resin volume. Moreover, the complexity of the operations involved in regenerating the spent resin, the large quantities of solutions necessary for effecting the regeneration, and the difficulty of disposing of the liquid effluents which are contaminated with the ammonium base and with products originating from the utilised resins make this process difficult to carry out on an industrial scale. Finally, exchanging the halide in alcoholic solution against alkaline bases does not enable alkali-free ammonium bases to be obtained because the alkaline halides have a certain solubility in alcoholic solutions.

Methods based on electrolysis have recently been proposed for exchange reactions. This relatively new technology has received a considerable impulse from the study and consequent availability of new semipermeable ionic membranes. U.S. Pat. Nos. 3,402,115 and 3,523,068 describe two processes which use electrolytic cells. The described methods are based on the synthesis of hydroxide from quaternary ammonium salts which have a non-electrolysable anion (sulphate, nitrate, carbonate). The method of the first patent (U.S. Pat. No. 3,402,115) is based on the use of an electrolytic cell (FIG. 1) comprising three compartments separated by two membranes, of which one is an anion exchange membrane (1) and one a cation exchange membrane (2). Initially an acid solution (using sulphuric acid) is fed into the anode compartment, the quaternary ammonium salt solution is fed into the central compartment and a very dilute aqueous solution of quaternary ammonium hydroxide is fed into the cathode compartment. On passing current, the cation Tetra Alkyl Ammonium ($TAA^+$) (3) migrates towards the cathode through the cation exchange membrane, and the anion (4) migrates towards the anode through the anion exchange membrane. $H_2$ (5) develops in the cathode zone to form a TAAOH solution, whereas $O_2$ (6) develops in the anode zone to form an acid solution.

The method of the second patent (U.S. Pat. No. 3,523,068) is based on the use of an electrolytic cell (FIG. 2) comprising two compartments separated by a cation exchange membrane (2). Initially the anode compartment is fed with an acid solution of a quaternary ammonium salt having an anion which does not discharge by electrolysis, and the cathode compartment is fed with distilled water. On passing current the cation (3) passes into the cathode compartment where $H_2$ (5) develops to form a TAAOH solution, whereas $O_2$ (6) develops in the anode compartment and the pH reduces.

The limits of these methods are: the need to use quaternary ammonium salts other than halides, and which have to be synthesised from alkyl sulphates (of which the noxiousness has already been mentioned); the presence of highly acid solutions which lead to corrosion resistance problems for the materials of construction; and the use of cation membranes which have to be highly selective towards the alkyl ammonium group, so that each alkyl ammonium salt requires an appropriate type of membrane according to the composition of the organic part.

These membranes also allow passage of undissociated salt towards the cathode, and thus do not ensure a high exchange yield, and the product obtained does not have the required high purity characteristics. In this respect, in the process described in U.S. Pat. No. 3,523,068, the base obtained is then purified by passage over anion exchange resin, and this leads to the stated drawbacks of the relative process. (Eisenhauer et al. U.S. Pat. No. 3,523,068 page 4 line 35).

Finally, in electrolytic processes based on the migration of the alkyl ammonium cation, it has been observed that this latter migrates together with numerous molecules of solvation of $H_2O$, this constituting an obstacle in obtaining concentrated base solutions.

A process has now been surprisingly found for the synthesis of quaternary ammonium hydroxides, which uses substances of low noxiousness, is simple to operate, and is of low plant and running costs. The quaternary ammonium hydroxides produced by this process have a low production cost and a high purity level, in contrast to the quaternary bases produced by known processes, which are of modest purity and high production cost.

SUMMARY OF THE INVENTION

The present invention provides a process for preparing quaternary ammonium hydroxides which is based on the use of an electrolytic cell comprising two compartments, namely an anode and a cathode compartment, separated by a semipermeable anion exchange membrane, and starting from quaternary ammonium halides.

The quaternary ammonium halide can also be a tetraalkylammonium halide. In this respect, said process can, for example, be applied to the synthesis of tetrapropylammonium hydroxide starting from the relative bromide.

DETAILED DESCRIPTION OF THE PREFERRED EMBODIMENTS

Figure 1:
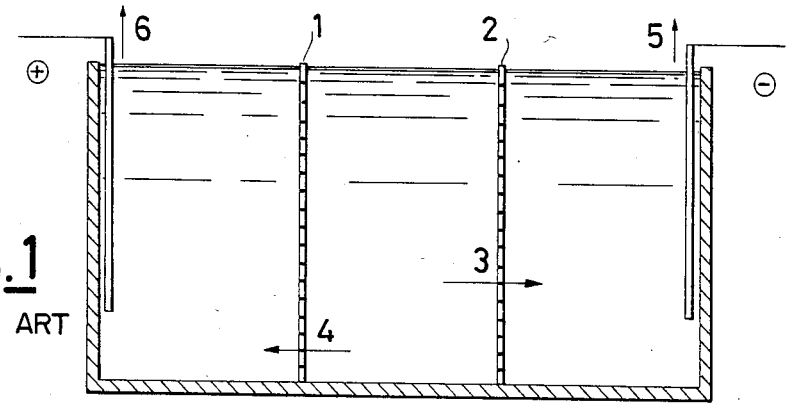
Fig.1 PRIOR ART
FIG. 1 is an illustration of an electrolytic cell as it can be used to carry out the prior art method described in U.S. Pat. No. 3,402,115.
Figure 2:
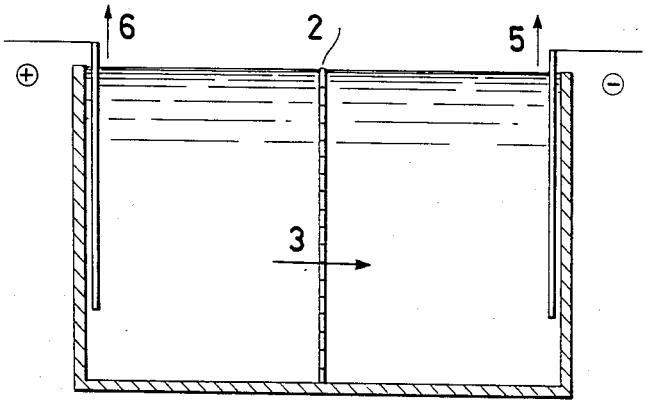
Fig.2 PRIOR ART
FIG. 2 is an illustration of an electrolytic cell used to conduct the prior art method of U.S. Pat. No. 3,523,068.
Figure 3:
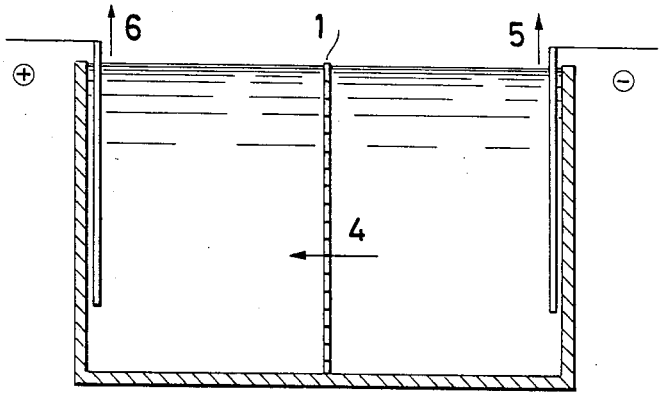
FIG. 3 illustrates an electrolytic cell as used to carry out a preferred way in which the process of this invention can be practiced.

The process according to the invention is described hereinafter with reference to FIG. 3, which shows a non-limiting embodiment thereof.

The process is based on the use of an electrolytic cell comprising two compartments, namely an anode and a cathode compartment, separated by a permselective anion exchange membrane (1).

A $NH_4OH$ solution is fed into the anode compartment and a solution of the quaternary ammonium halide is fed into the cathode compartment. On applying a potential difference across the two electrodes, the halide anions migrate (4) from the cathode compartment to the anode compartment through the membrane.

Hydrogen (5) develops at the cathode, and oxygen (6) at the anode. The pH of the anode compartment reduces during the process due to gradual neutralisation of $NH^+{}_4$ by the halide.

The oxygen discharge voltage ($20H=\frac{1}{2}O_2+H_2O+2e$) is a function of the pH and increases as this latter decreases in accordance with the equation $E_o=E_o'-0.059$ pH, where $E_o'$ is the discharge voltage at pH=0, and is 1.227 volts at 25° C. when the anode is formed from a material on which the discharge overvoltage is almost zero, such as Pt. To prevent the discharge and consequent undesirable appearance of halogens in the anode compartment, the pH of this latter must be maintained at a value of >8, and any necessary corrections can be made by small additions of $NH_3$ during the process.

At the end of the process the anode compartment contains an ammoniacal solution of ammonium halide whereas the cathode compartment contains an aqueous solution of quaternary ammonium hydroxide. In some cases there is a small quantity of ammonia present in the catholyte, depending on the duration of the process. This can be easily eliminated by distillation and with the aid of a light stream of nitrogen of $CO_2$-free air bubbled into the solution. The process is suitable for batch operation. The anode can be graphite, platinum, titanium platinate etc.

The cathode can be graphite, stainless steel, titanium platinate etc.

The operating temperature can be between 15° C. and 60° C., but preferably between 25° C. and 45° C.

The solutions in the two compartments can be kept under moderate agitation. This improves the liquid renewal at the electrode and membrane surfaces, where concentration gradients could form, and in that zones of neutral or slightly acid pH could form in proximity to the anode, so favouring halide discharge.

The anion exchange membrane can be any of the anion exchange membranes used in processes for the desalination of brackish water, and the more the membrane is selective with respect to the $NH_4^+$, $X^-$ ions ($X^-$ being the anion), the greater will be the process exchange yield.

In accordance with the indicated process and when the electrolytic process is conducted on a batch basis the Faraday yield is between 30 and 65%, and the percentage exchange can be pushed to beyond 98%, with a useful product yield of the same value.

The quaternary ammonium halide fed into the cathode compartment is in aqueous solution. Preferably said halide is at a concentration of between 10 and 60% by weight, and more preferably between 20 and 40% by weight.

The advantages of operating in the described manner are apparent. Firstly, any type of anion membrane can be used for all the alkyl ammonium halides independently of the nature of the organic chain, given that it is the anion which migrates. This enables all the required bases to be prepared using a single apparatus and a single type of membrane. The useful product is obtained with a sufficient Faraday yield and with low electricity consumption. The electrolysis can be carried out in such a manner as to cause all the anions to migrate, and thus obtain a pure base.

Two examples are given hereinafter in order to better illustrate the invention, but they are in no way limitative thereof.

EXAMPLE 1

The electrolytic cell used comprises an anode compartment and a cathode compartment which are separated by an anion exchange membrane of area 30 $cm^2$ supplied by BDH.

The electrodes are of graphite with a surface area of 24 $cm^2$. An aqueous solution of tetrapropylammonium bromide prepared by dissolving 80 g of salt in 450 g of distilled water is fed into the cathode compartment of the electrolytic cell.

500 g of a 4.8 weight % aqueous solution of $NH_3$ are fed into the anode compartment.

The two solutions are kept circulating through their compartments by means of two liquid pumps.

A water-fed heat exchanger is connected into the cathode circuit in order to keep the solution temperature below 25° C.

Figure 4:
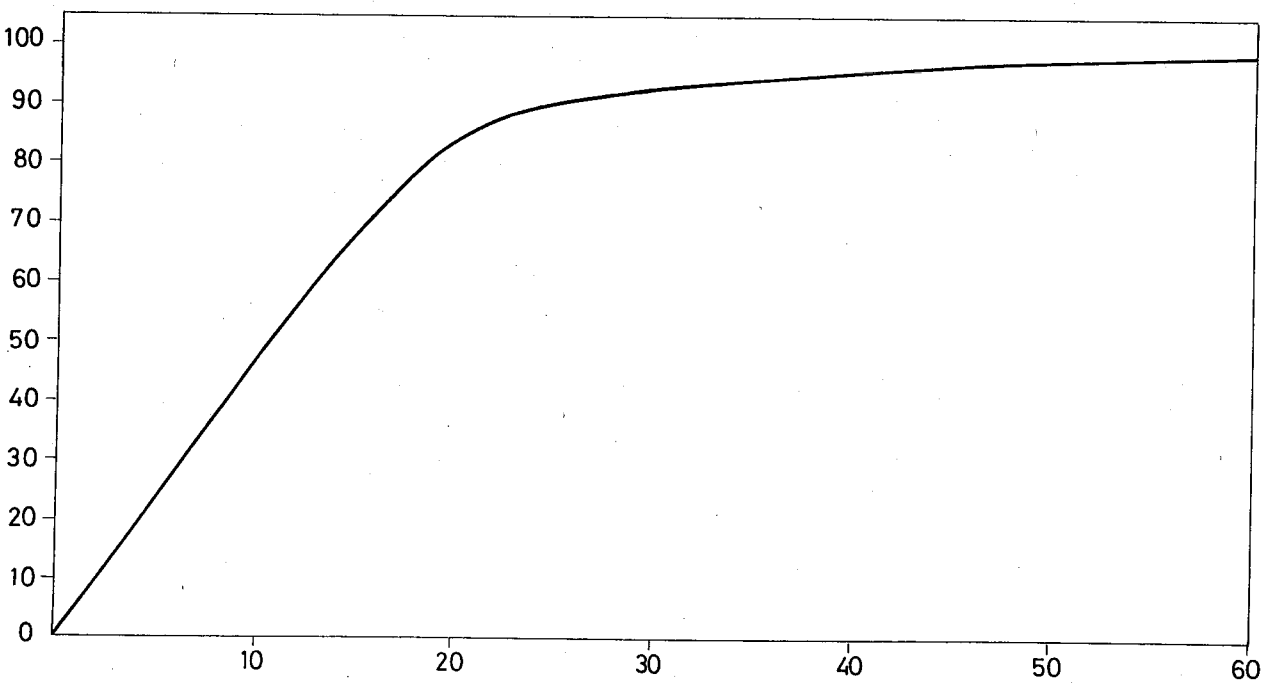
FIG. 4 is a graph of the percentage of $Br^-$ exchanged in the cathode compartment of the cell in FIG. 3, as a function of the current passed through the cell.

On applying voltage to the cell, the resistance offered by the solution at the beginning of the test reduces as dialysis proceeds, and tends to stabilise at a constant value. The applied voltage must be such as to obtain a cathode potential $>-2.0$ V when measured against a saturated calomel electrode. FIG. 4 shows the percentage $Br^-$ exchanged in the cathode compartment as a function of the current quantity which has passed through the cell. On the graph, the ordinate axis represents the % $Br^-$ exchanged, and the abscissa axis represents the ampere-hours.

Table 1 shows the analytical results for two samples, which were withdrawn after eight hours of operation and at the end of the test.

TABLE 1

| | Electrolysis 8 hours | | Electrolysis 17 hours | |
|---|---|---|---|---|
| | Cathode compartment | Anode compartment | Cathode compartment | Anode compartment |
| $Br^-$, grams | 1.66 | 20.82 | 0.16 | 22.30 |
| Total alkalinity equivalent to stated grams of TPAOH | 58.63 | | 70.84 | |
| TPAOH (after elimination of $NH_3$; $NH_3$ residue 10 ppm), grams | 50.5 | | 52.40 | |
| % $Br^-$ exchanged | 93.1 | | 99.3 | |
| $Br^-$ balance | | | 93.6 | |
| TPAOH yield | | | 85.82 | |

The Br balance is defined as follows:

$$\frac{\text{grams } Br^- \text{ found (anode + cathode)}}{\text{grams } Br^- \text{ fed}} \times 100$$

and is 93.6 after 17 hours of electrolysis.

The quaternary ammonium base (TPAOH) yield is defined as follows:

$$\frac{\text{grams of TPAOH obtained}}{\text{grams of TPAOH corresponding to the TPA Br fed}} \times 100$$

and is 85.82 after 17 hours of electrolysis.

After eliminating the ammonia, the cathode solution was analysed for impurities, and gave the following results:

| | |
|---|---|
| Na | 2 ppm |
| K | 0.0 ppm |
| Fe | 0.1 ppm |
| Br | 300 ppm |
| $NH_3$ | 10 ppm |

EXAMPLES 2–5

Various tests were carried out using the cell described in Example 1 and the same procedure, but varying the test duration and thus the total ampere-hours per unit of TPA.Br weight, the results being shown in Table 2.

The cathode discharge of the quaternary ammonium cations can take place in accordance with two mechanisms which can be represented schematically as follows (M. Finkelstein, R. C. Peterson, S. D. Ross, J. Am. Chem. Soc. 81, 2361, (1959)).

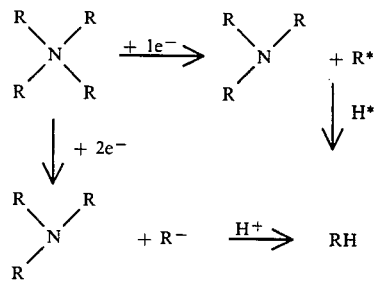

During the tests which were carried out, the anode and cathode solutions and the gas evolved at the electrodes were analysed, and no traces of alkanes or alkenes were found.

Direct measurements of the cathode potential under the described operating conditions and at current densities of 19 mA/cm² and 100 mA/cm² gave −0.86 V and −1.82 V respectively against a standard calomel electrode. These potential values are much less than the discharge potential of the tetrapropylammonium ion (−2.52 V against SCE on Hg). These tests show that there is no degradation of the tetraalkylammonium ion during the process.

The $Br^-$ and tetrapropylammonium hydroxide balances in Tables 1 and 2 are influenced by small solution losses due to the various manipulations and the level of purity of the bromide used.

TABLE 2

| | Cathode solution | | | | Anode solution | | | |
|---|---|---|---|---|---|---|---|---|
| | Initial $Br^-$ g | Final $Br^-$ g | TPA—OH g | TPA—OH yield % | Final $Br^-$ g | $Br^-$ balance | % $Br^-$ exchanged | Ampere-hours |
| Dialysis 2 (—$NH_3$) | 24.0 | 1.26 | 55.1 | 90.26 | 21.70 | 95.70 | 94.8 | 34 |
| Dialysis 3 (—$NH_3$) | 24.0 | 0.71 | 52.1 | 85.30 | 20.80 | 89.50 | 97.0 | 47 |
| Dialysis 4 (—$NH_3$) | 24.0 | 0.23 | 60.2 | 99.80 | 23.65 | 99.50 | 99.0 | 51 |
| Dialysis 5 (—$NH_3$) | 24.0 | 0.16 | 52.4 | 85.82 | 22.30 | 93.58 | 99.3 | 54 |

We claim:

1. In a process for preparing quaternary ammonium hydroxides by electrolysis in an electrolytic cell comprising an anode compartment, containing an anode, and a cathode compartment, containing a cathode, the improvement comprising providing a quantity of a quaternary ammonium halide to the cathode compartment and subjecting said halide to electrolysis, wherein the two compartments are separated by a semi-permeable anion exchange membrane and the discharge of halogen at the anode is prevented by controlling the pH of the liquid in the anode compartment.

2. A process as claimed in claim 1, wherein the quaternary ammonium halide is a tetraalkylammonium halide.

3. A process as claimed in claim 2, wherein the tetraalkylammonium halide is a tetrapropylammonium halide.

4. A process as claimed in claim 2, wherein the pH is maintained greater than 8 by adding ammonia to said anode compartment as the process proceeds.

5. A process as claimed in claim 1, wherein the quaternary ammonium halide is the bromide.

6. A process as claimed in claim 1, characterised by operating at a temperature of between 15° and 60° C.

7. A process as claimed in claim 6, wherein the temperature is between 25° and 45° C.

8. A process as claimed in claim 1, wherein the quaternary ammonium halide is in aqueous solution at a concentration of between 10 and 60% by weight.

9. A process as claimed in claim 8, wherein the quaternary ammonium halide is at a concentration of between 20 and 40% by weight.

10. A process as claimed in claim 1, wherein halogen discharge at the anode is prevented by maintaining the pH of the anode compartment greater than 8.

* * * * *